US006213917B1

(12) United States Patent
Ladin et al.

(10) Patent No.: US 6,213,917 B1
(45) Date of Patent: Apr. 10, 2001

(54) SWIMMER'S TRAINING METHOD

(75) Inventors: Eli M. Ladin, 1608 Morton Ave., Ann Arbor, MI (US) 48104; Robert I. Gault, Sand Point, MI (US)

(73) Assignee: Eli M. Ladin, Ann Arbor, MI (US)

( * ) Notice: Subject to any disclaimer, the term of this patent is extended or adjusted under 35 U.S.C. 154(b) by 0 days.

(21) Appl. No.: 09/151,649

(22) Filed: Jul. 7, 1997

(51) Int. Cl.[7] ..... A63B 69/12

(52) U.S. Cl. ..... 482/3; 434/247; 434/254; 368/10; 368/107

(58) Field of Search ..... 482/1–9, 900–902; 351/158; 381/77; 368/2, 10, 69, 101–113; 340/850, 323 R; 434/247, 254

(56) References Cited

U.S. PATENT DOCUMENTS 4,780,085 10/1988 Malone .
4,796,987 1/1989 Linden .
4,823,367 4/1989 Kreutzfeld .
5,585,871 * 12/1996 Linden ..... 351/158
5,600,730 * 2/1997 Kenning et al. ..... 381/77
5,921,890 * 7/1999 Miley ..... 482/3

* cited by examiner

*Primary Examiner*—Glenn E. Richman
(74) *Attorney, Agent, or Firm*—Alex Rhodes

(57) ABSTRACT

A training apparatus for improving the performance of a swimmer. In a first aspect of the invention, a propeller rotates about an axis which is aligned with the path of the swimmer. A permanent magnet driven by the propeller attached to the swimmer produces a rotating magnetic field which acts on a magnetic field transducer to produce a pulsating signal whose frequency varies directly with the swimmer's speed. The sensor's output is multiplied, amplified and fed to an earphone worn by the swimmer. Changes in frequency immediately inform the swimmer of whether his performance has improved or deteriorated.

In a second aspect of the invention, permanent magnets are mounted on vanes of an impeller which rotate about a horizontal axis which is at right angles to the path of the swimmer. Rotating magnetic fields of the permanent magnets act on a magnetic field sensor to produce a pulsating signal whose frequency varies with the swimmer's speed.

10 Claims, 10 Drawing Sheets

SWIMMER'S TRAINING METHOD

FIELD OF THE INVENTION

This invention relates to training methods and more particularly to a method for improving a swimmer's performance.

BACKGROUND OF THE INVENTION

Small changes in form or movement, such as changes in the angle of a hand or the movement of a head can significantly reduce the swimmer's speed and increase fatigue. Heretofore, only lap counters and timing devices such as stop watches have been used for evaluating a swimmer's performance. The effects of small changes in form and movement have either been overlooked or not been readily detectable by either the swimmer or an observer such as a coach. Consequently, there was no way for the swimmer to know, while swimming, whether a specific change in his swimming technique increased or decreased his speed.

Linden, U.S. Pat. No. 4,796,987; Kreutzfeld, U.S. Pat. No. 4,823,367; and Malone, U.S. Pat. No. 4,780,085 are exemplary of the prior art. Linden merely discloses a stop watch mounted in a transparent lens of a goggle, mask, or shield worn by a swimmer. The stop watch reset button is manually activated by the swimmer before the swimmer starts swimming and after the swimmer stops swimming.

Kreutzfeld discloses an apparatus for counting the number of laps of a swimmer comprised of a portable unit worn by the swimmer and a stationary unit which establishes a zone of detection. Each time the portable unit passes the stationary unit a signal is conveyed to register a completion of a lap.

Malone discloses a lap timing device consisting of a clock/timer, a switch for starting the clock/timer and a proximity sensor for detecting a completion of a lap.

SUMMARY OF THE INVENTION

A principal object of the present invention is to enable a swimmer to immediately determine, while swimming, whether small changes in form and/or movement have improved or deteriorated his swimming performance. Another object is to provide a portable training apparatus which can be attached to a swimmer.

These objects are accomplished by attaching a compact module to a mid portion of a swimmer which transmits a train of audio signals to the swimmer that vary directly in frequency with the swimmer's speed. The invention resides in novel steps which individually and collectively contribute to its ability to immediately inform a swimmer of the effects of changes in his form and/or movements and thus enable him to optimize his technique.

One characteristic feature of the invention is that an audio signal is used to inform a swimmer of whether his speed has increased or decreased. Another characteristic feature is that a compact module is attached to the swimmer for monitoring the swimmer's performance.

Another feature of the invention is that the module is automatically activated when it is immersed in water and deactivated when it is taken out of the water. Another feature of the invention is that the module can be re-positioned on a swimmer to accommodate different swimming strokes.

In a first form of the module, a propeller rotates about an axis which is aligned with the path of the swimmer. A permanent magnet driven by the propeller produces rotating magnetic field which acts on a magnetic field transducer, such as a Hall effect or magneto-resistive transducer to produce a pulsating signal whose frequency varies directly with the swimmer's speed. The sensor's output is multiplied, amplified and fed to an earphone worn by the swimmer. Changes in frequency immediately inform the swimmer of whether his performance has improved or deteriorated.

In a second form of the module, permanent magnets are driven by an impeller which rotates about a horizontal axis which is at right angles to the path of the swimmer. Rotating magnetic fields of the magnet act on a magnetic field sensor.

Further objects, benefits and features of the invention will become apparent from the ensuing detailed description and drawings which disclose the invention. The property in which exclusive rights are claimed is set forth in each of the numbered claims at the conclusion of the detailed description.

BRIEF DESCRIPTION OF THE DRAWINGS

The invention will be better understood and further objects, characterizing features, details and advantages thereof will appear more clearly with reference to the diagrammatic drawings illustrating a presently preferred specific embodiment of the invention by way of non-limiting example only.

DETAILED DESCRIPTION OF THE PREFERRED EMBODIMENT

Figure 1:
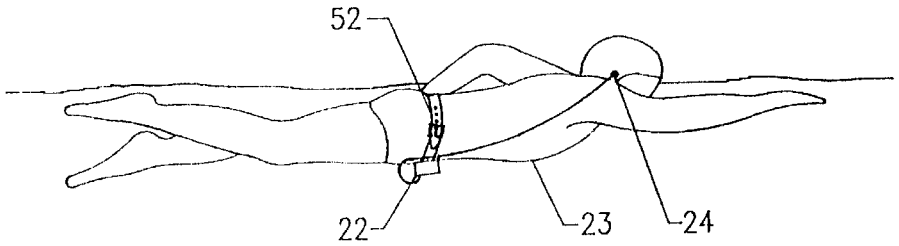
FIG. 1 is a right side view of a swimmer with a training apparatus according to my invention.
Figure 2:
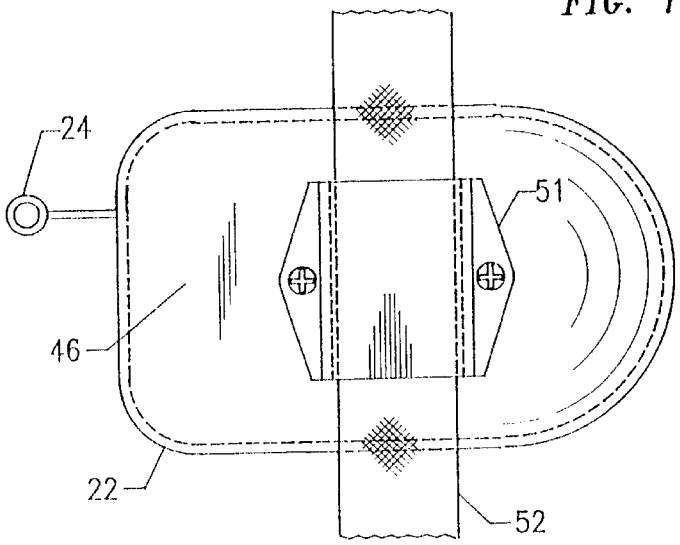
FIG. 2 is a plan view of a module of the training apparatus which is mounted on the underside of the swimmer in FIG. 1.
Figure 3:
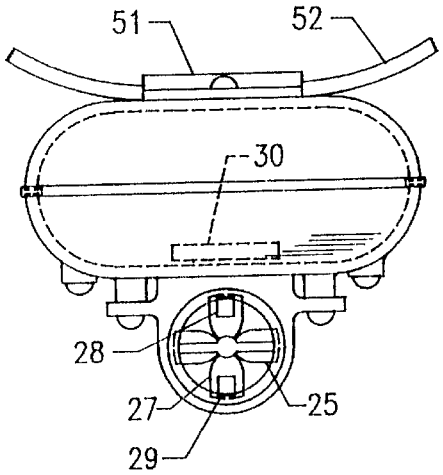
FIG. 3 is a front view of the module.
Figure 4:
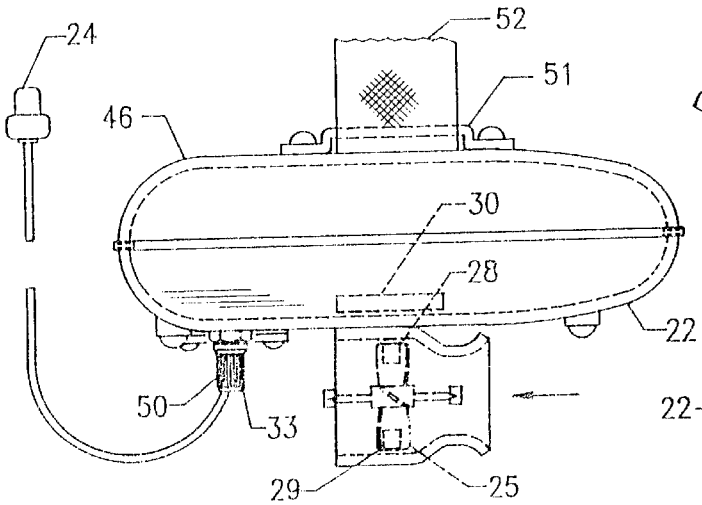
FIG. 4 is a right side view of the module.
Figure 5:
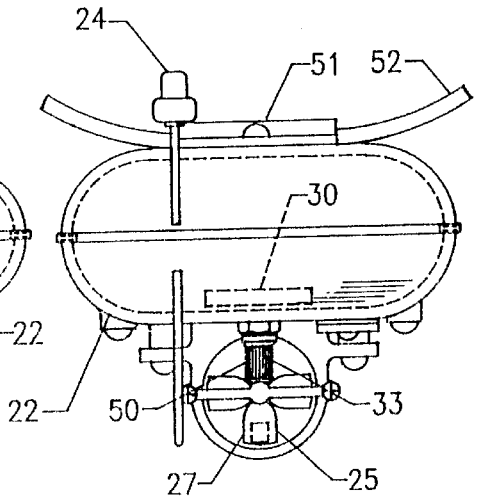
FIG. 5 is a rear view of the module.
Figure 6:
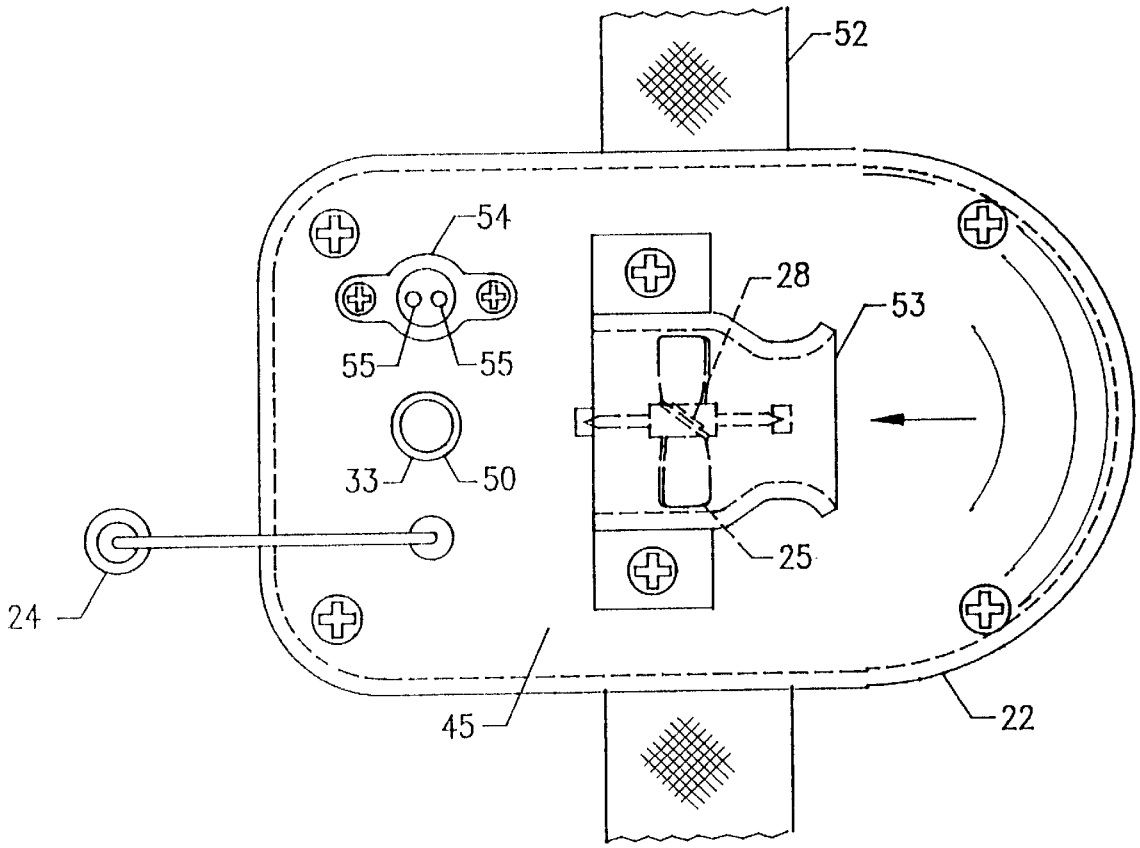
FIG. 6 is an enlarged bottom view of the module.

Referring now to the drawings wherein like numerals designate like and corresponding parts throughout the several views, a training apparatus for improving a swimmer's performance is shown in FIGS. 1 through 8 inclusive. Actual tests of the invention have shown the apparatus to be very effective for improving a swimmer's performance.

Figure 19:
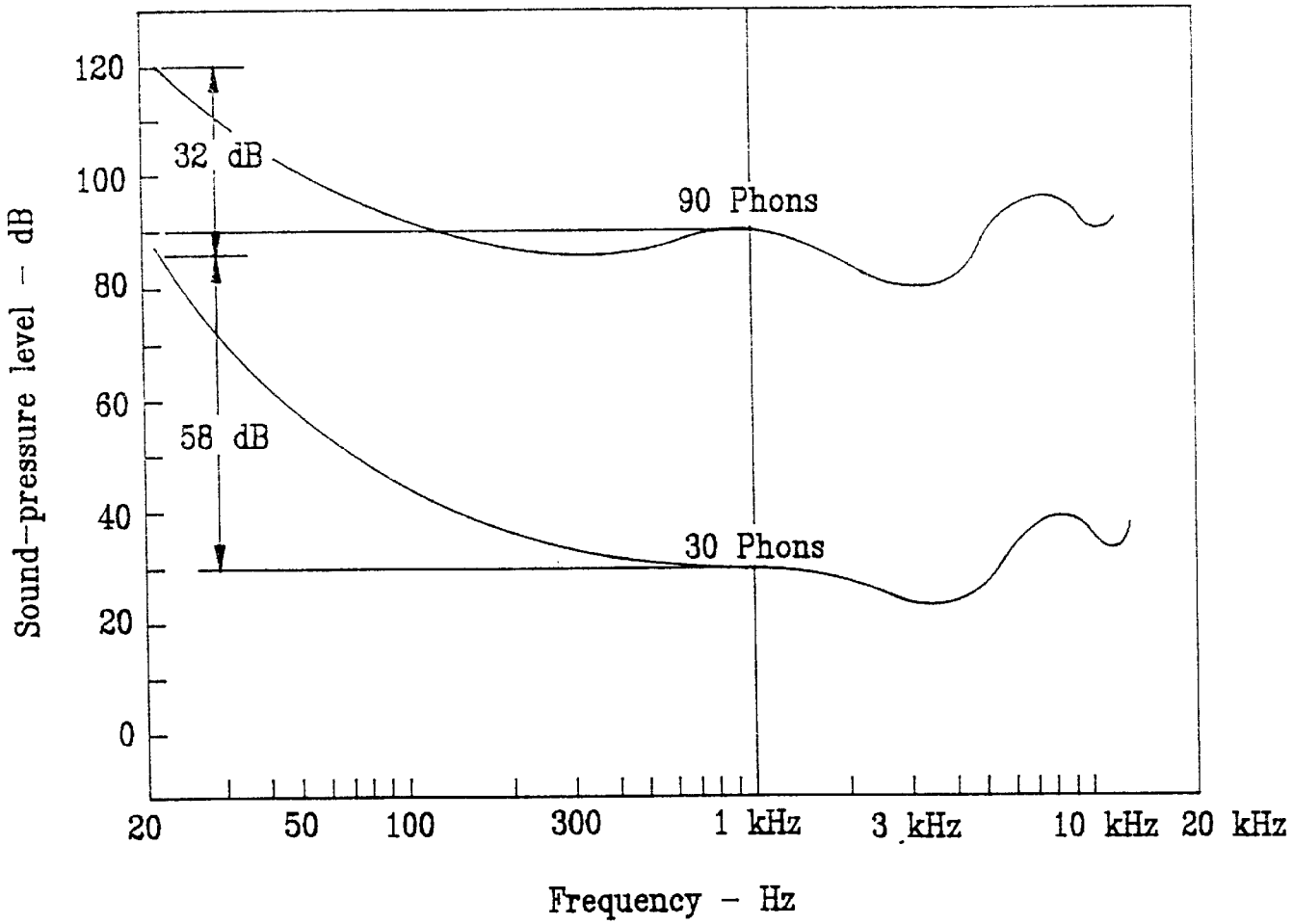
FIG. 19 is a comparison graph of an ear's response at 20 Hz compared to that at 1,000 Hz.

The basic concept of the invention is to apply the remarkable power of the human ear to analyze sounds to improve a swimmer's performance. As shown in FIG. 19, the sensitivity of the human ear to sound is greatest around 3 Khz and decreases with lower Everest, in the *Master Handbook of Accoustics,* discloses "there are about 280 discernible steps in intensity and some 1,400 discernible steps in pitch that can be detected by the human ear." (Everest, page 849).

The power of the ear to analyze sounds is used by transmitting to a swimmer an audio signal whose frequency varies in accordance with the swimmer's speed. Changes in properties of the audio signal, such as pitch and frequency, immediately inform the swimmer of whether his performance has improved or deteriorated.

In FIG. 1, a compact module 22 is mounted on an unobstructed mid-portion of a swimmer 23 and is connected to an earphone 24 worn by the swimmer 23. The module 22 transmits a pulsating audio signal to the swimmer 23 whose frequency varies directly with the swimmer's speed. By way of example, if the swimmer's speed increases, the frequency of the audio signal linearly increases. Changes in audio frequency immediately inform the swimmer 23 of whether he is speeding up or slowing down.

Figure 17:
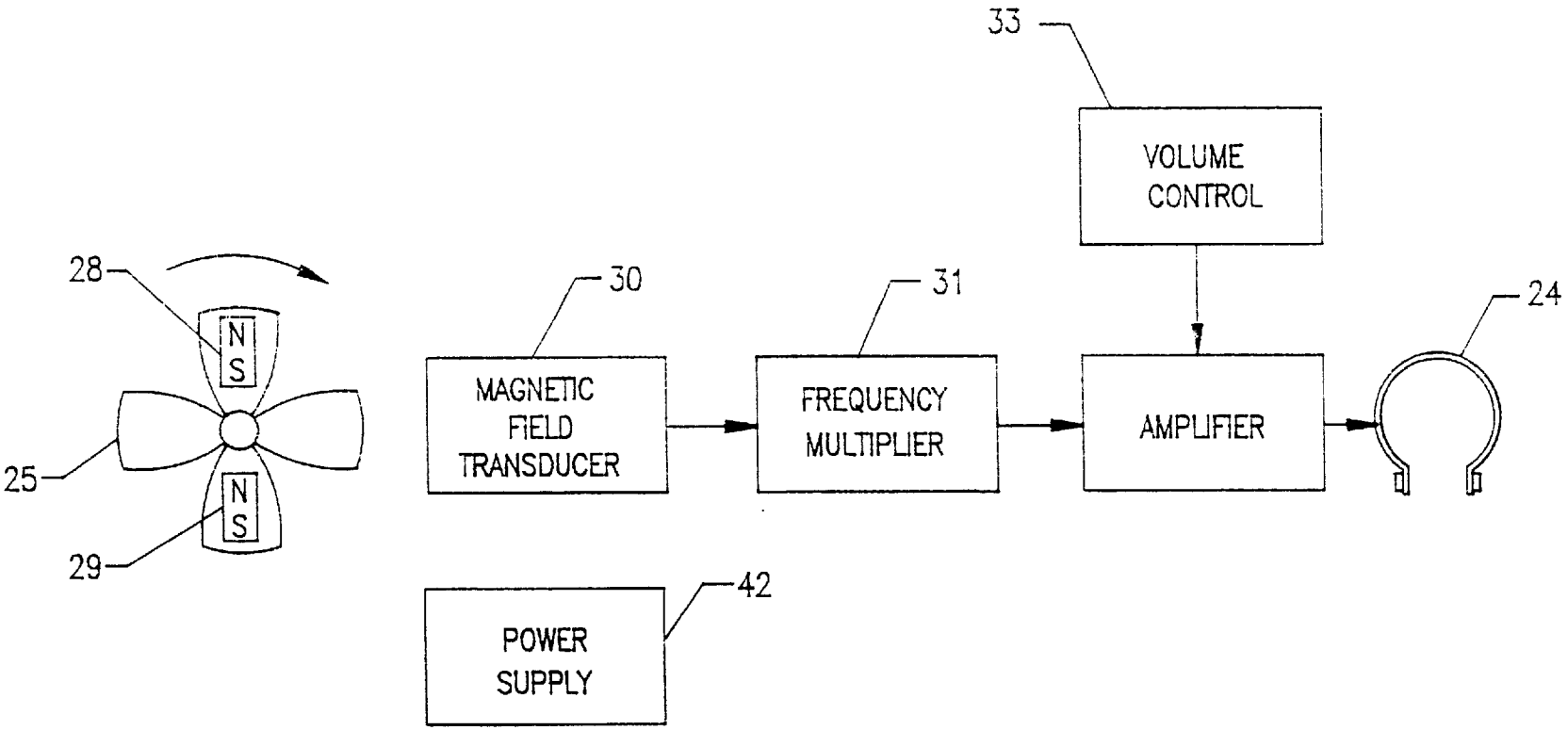
FIG. 17 is a block diagram of the swimmer's training apparatus shown in FIGS. 1–8.

The preferred embodiment can be broadly understood by the following description with reference to the block diagram in FIG. 17. A propeller 25 in suspended relationship with the module 22 is driven by the forward motion of a swimmer 23. The propeller 25 has a pair of permanent magnets 28 and 29 mounted at the ends of a pair of opposing blades 27. One of the permanent magnets 28 has an outward facing north pole and the other 29 has an outward facing south pole. A forward motion of the swimmer 23 causes the propeller 25 to rotate and produces pairs of rotating magnetic fields. A magnetic field sensor 30, such as a Hall or a magneto-resistive magnetic field sensor within the rotating magnetic fields produces a pulsating output signal which varies directly in frequency with the speed of the swimmer 23.

The frequency of the sensor's output signal is multiplied by a frequency multiplier 31, amplifier 32 and fed to the earphone 24 worn by the swimmer 23. Changes in signal frequency immediately inform the swimmer 23 of whether his speed is increasing or decreasing. A volume control 33 is provided to compensate for changes in battery voltage, background noise and the hearing capability of the swimmer 23.

Figure 7:
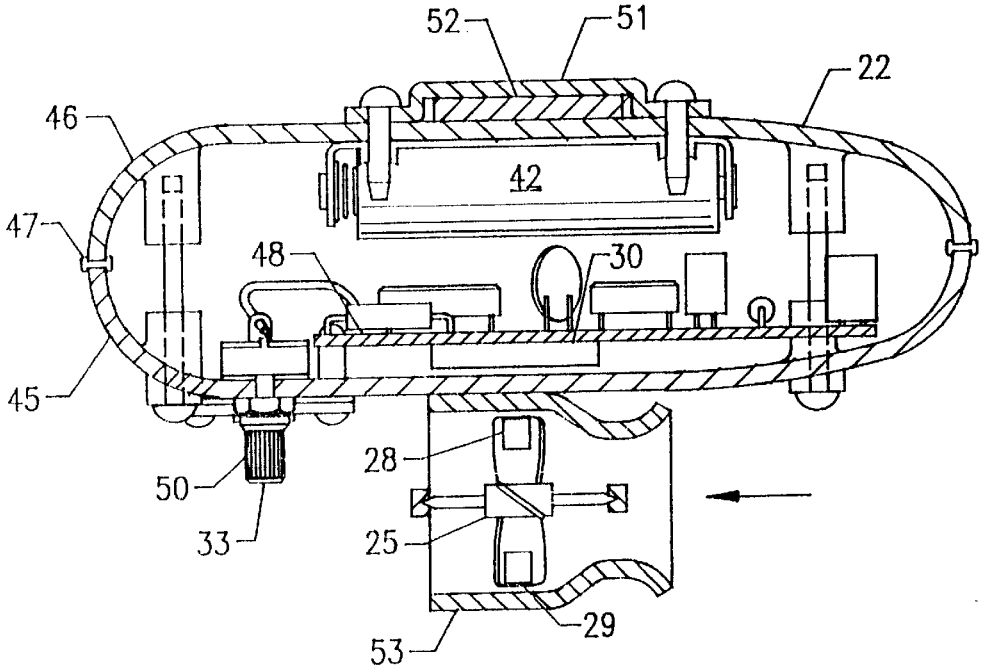
FIG. 7 is an enlarged cross-sectional view taken on the line 7—7 in FIG. 2.

Referring now to FIG. 7, the magnetic field sensor 30 is a conventional type digital output transducer, such as a digital output Hall sensor or magneto-resistive sensor. The sensor 30 has two output states, namely, an "ON" and an "OFF" state. Each time a north facing pole passes the sensor 30, the sensor's output goes low and remains low until a south facing pole passes the sensor 30, causing the sensor's output to go high. During each rotation of the propeller 25, the sensor 30 produces one pulse. At a given propeller speed, the number of pulses per revolution can be increased by increasing the number of pairs of poles on the propeller and/or multiple sensors. Since the speed of the propeller 25 varies directly with the speed of the swimmer, the sensor 30 in the rotating magnetic field provides a convenient means for evaluating changes in a swimmer's performance.

Figure 9:
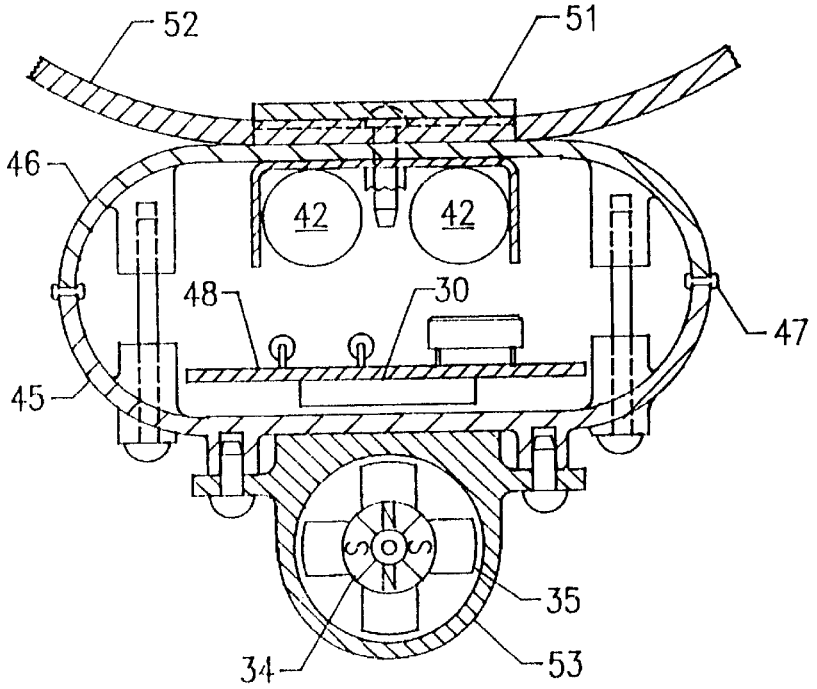
FIG. 9 is an enlarged cross-sectional view of an alternate embodiment taken in a similar manner as FIG. 8 wherein a ring magnet is mounted on a propeller.

A pulsed sensor signal can also be obtained with a single permanent magnet. In FIG. 9, an embodiment is shown wherein a single ring magnet 34 with sequential pairs of north and south poles is driven by a propeller 35. The ring magnet may be mounted on the propeller 35 or a shaft which supports the propeller 35. During each revolution of the propeller 35, the sensor 30 produces a pair of pulses.

Figure 10:
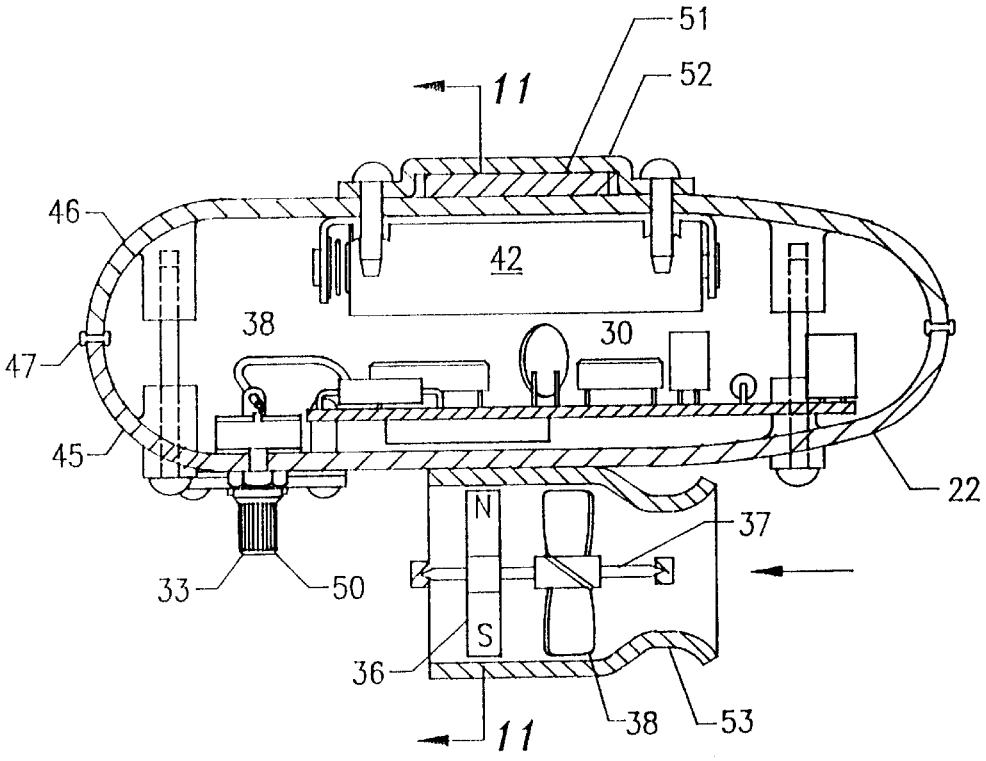
FIG. 10 is an enlarged cross-sectional view of an alternate embodiment taken in a similar manner as FIG. 8 wherein a bar magnet is mounted in spaced relationship on a common shaft with a propeller.
Figure 11:
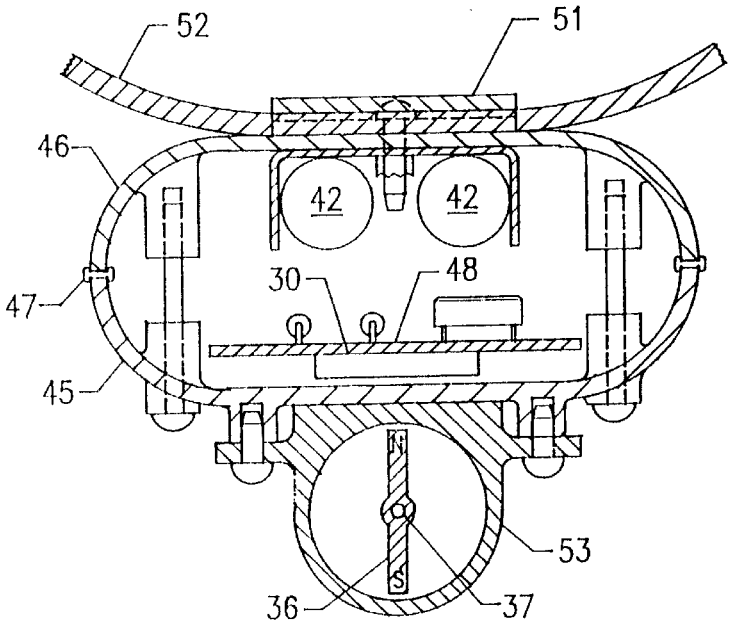
FIG. 11 is a cross-sectional view taken on the line 11—11 in FIG. 10.
Figure 12:
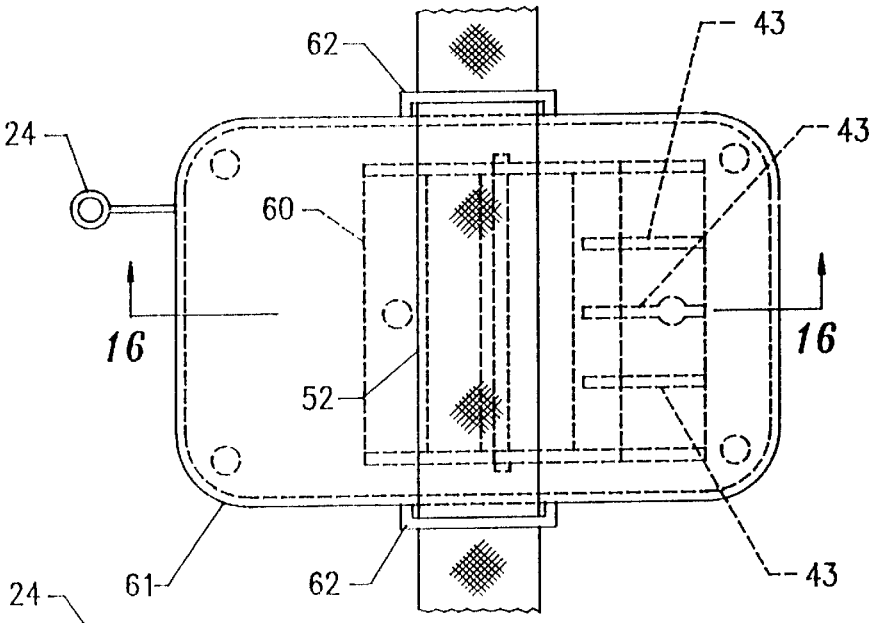
FIG. 12 is a plan view of an alternate embodiment of a swimmer's training apparatus wherein a pair of magnets are mounted on an impeller.

In FIGS. 10 and 11, a further example is shown wherein a single bar magnet 36 is mounted for rotation on a common shaft 37 in spaced relationship with a propeller 38. The magnetic field of the bar magnet 36 acts on the magnetic field sensor 30 and produces a single sensor pulse during each revolution of the propeller 38.

Frequency multiplication provides two important benefits. First, the effects of changes in a swimmer's form and movement on the swimmer's speed are magnified. For example, with a frequency multiplication of 100, a change of 2 revolutions per second of propeller speed produces a frequency change of 200 cycles per second in the audio signal which is transmitted to the swimmer 23. Second, higher audio frequency signals are more discernible over background noise.

Figure 18:
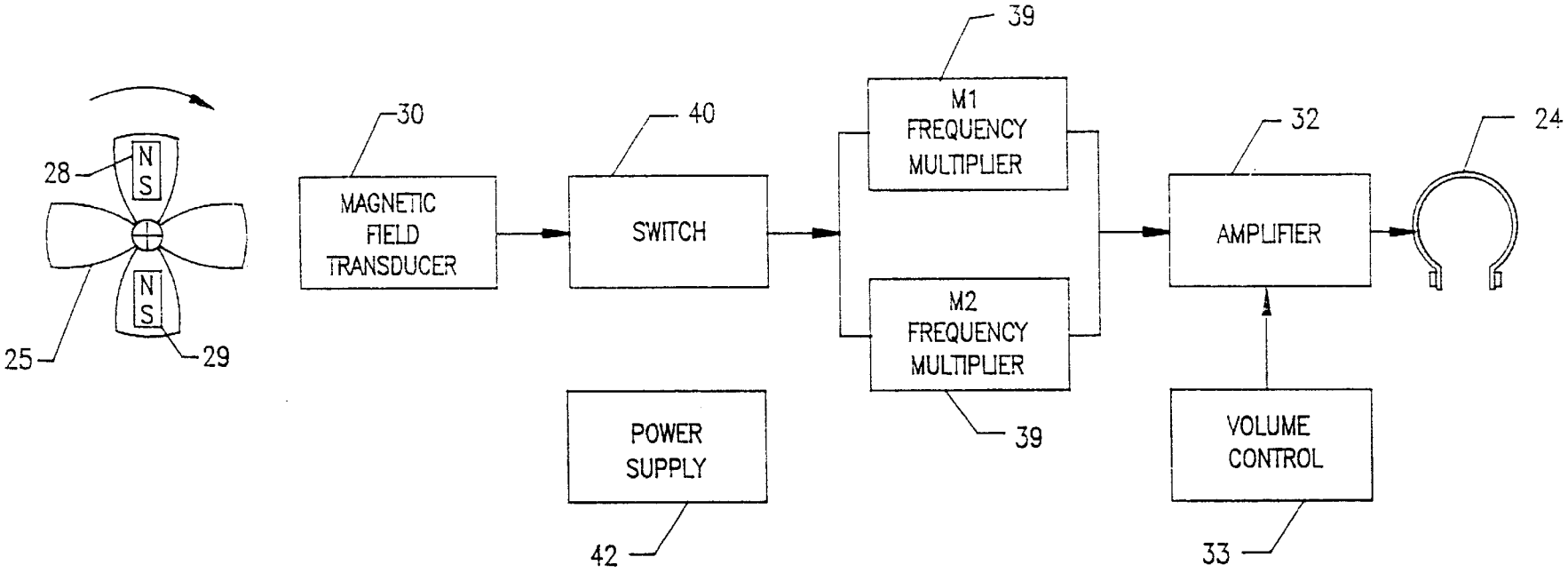
FIG. 18 is block diagram of an alternate embodiment of FIG. 17.

Suitable frequency multiplier circuits are well known in the art and include such circuits as frequency multipliers, digital up-counters, etc. Suitable audio amplifiers are also well known in the art. A frequency multiplier 31 may multiply the frequency by a fixed amount or be selectively adjustable by the swimmer 23. In FIG. 18, an embodiment is shown wherein a pair of optional frequency multipliers 39 arranged in parallel are selected by a switch 40.

Figure 8:
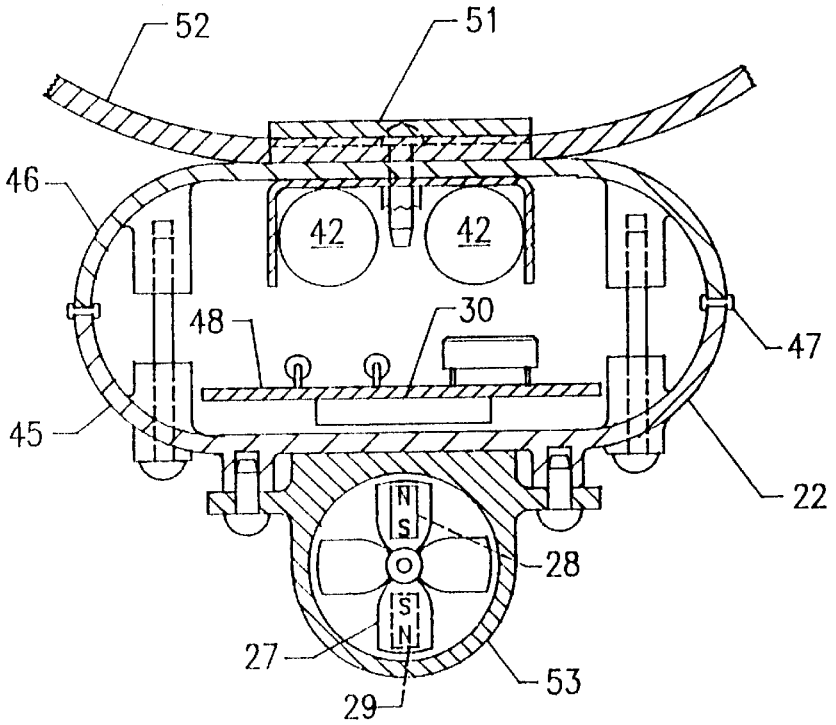
FIG. 8 is an enlarged cross-sectional view taken on the line 8—8 in FIG. 7.

With reference to FIGS. 7 and 8, electronic components including, an "On/Off" switch 54, a pair of batteries 42, a volume control 33, the magnetic field sensor 30, the frequency multiplier 31, and the audio amplifier 32 are mounted in a sealed housing 44. The housing 44 has a lower half 45, an upper half 46 and a seal 47 between the upper 46 and lower 45 halves. Inside of the housing 44 is a circuit board 48 which carries the frequency multiplier 31, the audio amplifier 32, and usual supporting components. The "On-Off" switch 54 and a volume control 33 extends through the lower half 45 of the housing 44. Attached to the volume control 33 is a knob 50 for adjusting the volume of the audio signal.

Mounted on the top of the housing upper half 46 is a bracket 51 which receives a belt 52 for attaching the module 22 to the swimmer 23. The position of the module 22, i.e., at a mid-point of the swimmer 23 is a feature of the invention. It provides an unobstructed water path in the direction of arrow "A" to the propeller 25 which is mounted for rotation in a shroud 53 which is attached to the underside of the housing 44. While performing a backstroke, the module 22 is preferably repositioned to the swimmer's back. The propeller 25 rotates about an axis which is aligned with the path of the swimmer 23.

Figure 20:
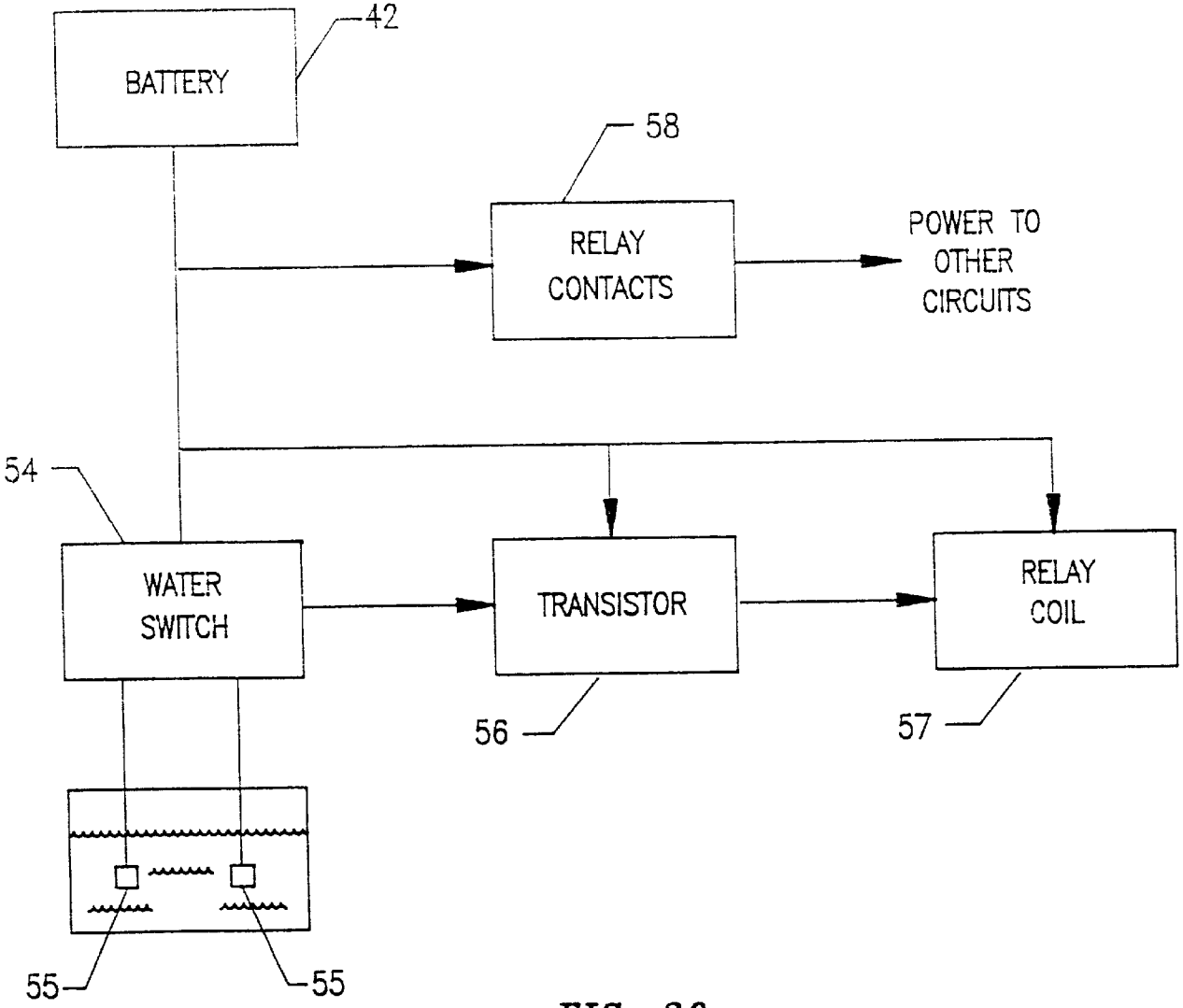
FIG. 20 is a block diagram of a water activated switch.

The "ON/OFF" switch 54 which is believed to be novel is a normally open water activated switch circuit which closes when the module 22 is immersed in water and opens when it is removed from water. The switch 54 provides the benefit of automatic operation and simplifies the requirement for a waterproof switch. When the module 22 is immersed in water, contact of the water with two exposed contacts 55 of switch 54 activates an "On-Off" circuit. With reference to FIG. 20, the switch 54 is connected to the batteries 42 and a circuit which remains active when power is interrupted from the other circuits. When the training apparatus is not in use, the active circuit which the switch 54 is connected to draws a negligible current, commonly referred to as "quiescent current" in the microamp range. When the module 22 is immersed in water, contacts 55 are shorted and a transistor 56 is turned on thereby energizing a relay coil 57. The relay's contacts 58 close, supplying power to the other circuits.

Referring now to FIGS. 12 through 16, inclusive, an alternate embodiment is illustrated having an impeller 59 mounted for rotation in a housing 60 which is suspended from a module 61. On the sides of the module 61 are a pair of integral brackets 62 which receive a belt 52 for attaching the module 61 to the swimmer 23.

Figure 13:
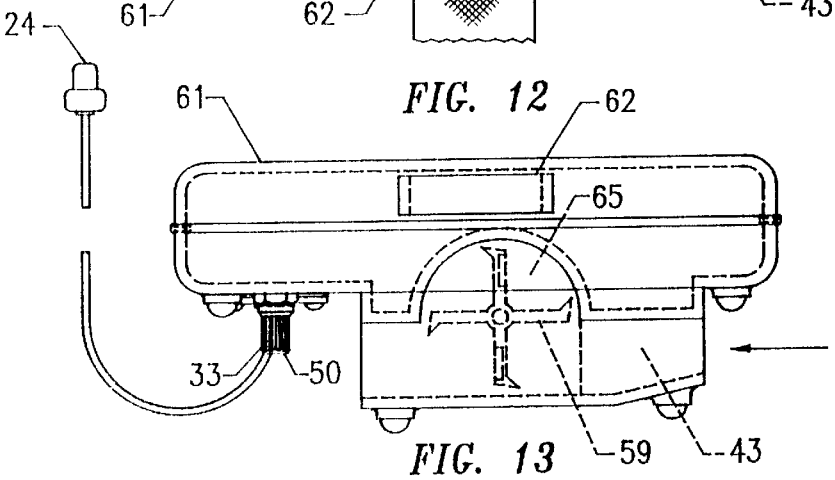
FIG. 13 is a right side view of the alternate embodiment shown in FIG. 12.
Figure 14:
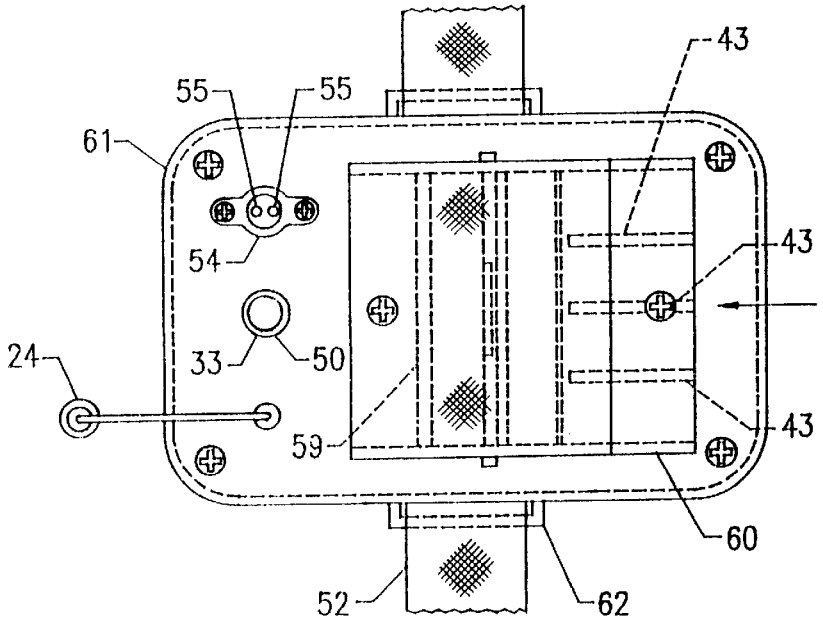
FIG. 14 is a bottom view of the alternate embodiment.
Figure 15:
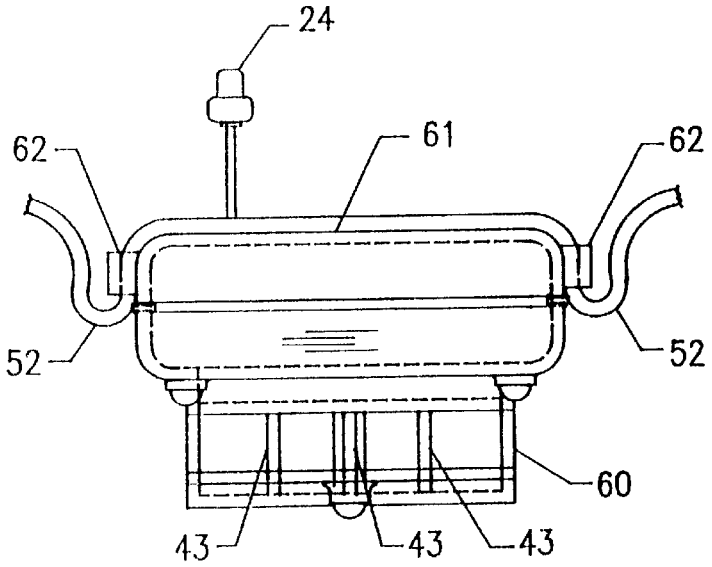
FIG. 15 is a front view of the alternate embodiment.

A forward portion of the impeller housing 60, as shown in FIG. 13, is open to allow water to enter the housing 60. The impeller 59 is suspended inside the housing 60 on a slender shaft 64. A lower portion of the module 61 has a recess 65 to position the impeller 59 close to a magnetic field sensor 30 inside the module 61.

The slender shaft 64 is oriented at right angles to the path of the swimmer 23 whereby when the swimmer 23 moves through water as shown in FIG. 1, water enters the housing 60, causing the impeller 59 to rotate about an axis which is at right angles to the swimmer's motion. In a forward portion of the housing 60 are vanes 43 to reduce turbulence and improve the flow of water through the housing 60.

Figure 16:
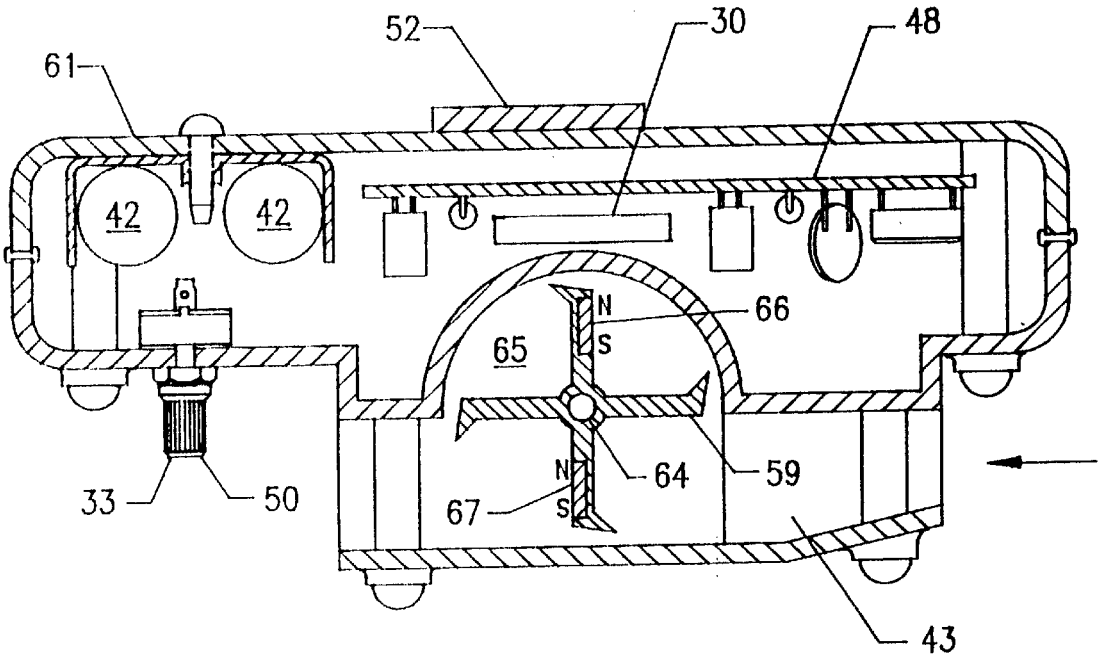
FIG. 16 is an enlarged cross-sectional view taken on the line 16—16 in FIG. 12.

Referring now to FIG. 16, a pair of bar magnets 66, 67 are attached to two opposite vanes 43 of the impeller 59. One of the bar magnets 66 has an outward facing north pole and the other of the magnets 67 has an outward facing south pole. A rotation of the impeller 59 produces rotating magnetic fields which act on the sensor 30 to produce a pulsed output.

From the foregoing, it will be appreciated that my invention provides a compact training apparatus which is adapted to be worn on a swimmer. Moreover, the training apparatus instantly informs a swimmer whether changes in form and movement improve or deteriorate his swimming performance.

Although only two embodiments have been illustrated and described, it is not my intention to limit my invention to these embodiments, since changes in material, shape, arrangement of components and substitution of components can be made without departing from the spirit thereof. By way of example, linear output magnetic field sensors with amplitude to digital (A to D) converters can be used in lieu of digital output magnetic field sensors.

What is claimed is:

1. A swimmer's training apparatus comprising: a compact module; a means for attaching said module to a swimmer, a means mounted in said module for producing an audible output signal which varies in frequency and/or pitch directly with the speed of said swimmer; and an earphone operatively connected to said module for receiving said audio output signal to inform said swimmer if his speed is increasing or decreasing.

2. A method for improving the performance of a swimmer comprised of the steps of: mounting an apparatus on about the mid-point of the abdomen of a swimmer for generating audio signals which vary in frequency and/or pitch directly with the speed of the swimmer; swimming with said audio device to generate said audio signals; varying said swimmer's form or motion; and transmitting said audio signals to an earphone worn by said swimmer to inform said swimmer whether said changes in said swimmer's form or motion have increased or decreased said swimmer's speed.

3. The method recited in claim 2 further comprising the step of increasing the frequency of said audio signal before said signal is transmitted to said swimmer.

4. The method recited in claim 2 wherein said audio signals are generated by at least one rotating magnetic field acting on a magnetic field sensor and signal processing circuits which convert a pulsating output of said sensor into said audio signals.

5. The method recited in claim 2 wherein said frequency of said audio signals is about 3000 cycles per second.

6. The method recited in claim 2 further comprising the step of repositioning said device at about the mid-point of the abdomen of said swimmer to generate said pulsating audio signal.

7. The method recited in claim 2 further comprising the step of repositioning said device at about the mid-point of the back of said swimmer for generating said audio signal.

8. A method for improving the performance of a swimmer comprised of the steps of: mounting an apparatus at about the mid-point of a swimmer which generates a pulsating audio signal having a frequency which varies directly with the speed of said swimmer; swimming with said apparatus attached to said swimmer to generate said pulsating audio signal; changing the form or motion of said swimmer to vary said frequency of said audio signal; and communicating said pulsating audio signal during said swimming to immediately inform said swimmer whether his speed is increasing or decreasing.

9. The method recited in claim 6 further comprising the step of automatically activating said apparatus when said apparatus contacts water.

10. In a method for improving the performance of a swimmer of the type wherein changes in said swimmer's form or motion are made and the effects are determined by changes in said swimmer's speed, the improvement comprising the steps of: mounting an apparatus on the mid-portion of said swimmer which generates a pulsating audio signal having a frequency and pitch which vary in accordance with said swimmer's speed; swimming with said apparatus to generate said pulsating audio signal; changing said swimmer's form or motion; and communicating said pulsating audio signal to said swimmer during said swimming to immediately inform him of whether said changes have increased or decreased his speed.

* * * * *